US007322374B2

(12) United States Patent
Gebauer et al.

(10) Patent No.: US 7,322,374 B2
(45) Date of Patent: Jan. 29, 2008

(54) ACTUATOR FOR ACTUATING A LIFT VALVE

(75) Inventors: Klaus Gebauer, Seelze (DE); Walter Strzoda, Barsinghausen (DE); Rudolf Kragl, Zolling (DE); Joachim Homeister, Taufkirchen (DE); Martin Lorscheid, Munich (DE); Rolf Connert, Munich (DE); Till Scheffler, Munich (DE); Rudi Seethaler, Munich (DE)

(73) Assignee: Bayerische Motorenwerke Aktiengesellschaft, Munich (DE)

( * ) Notice: Subject to any disclaimer, the term of this patent is extended or adjusted under 35 U.S.C. 154(b) by 351 days.

(21) Appl. No.: 10/489,290

(22) PCT Filed: Sep. 12, 2002

(86) PCT No.: PCT/EP02/10260

§ 371 (c)(1),
(2), (4) Date: Mar. 11, 2004

(87) PCT Pub. No.: WO03/023196

PCT Pub. Date: Mar. 20, 2003

(65) Prior Publication Data

US 2005/0022876 A1 Feb. 3, 2005

(30) Foreign Application Priority Data

Sep. 12, 2001 (DE) ..... 201 15 060

(51) Int. Cl.
*F16K 37/00* (2006.01)
*G01B 7/14* (2006.01)

(52) U.S. Cl. ..... 137/554; 324/207.15; 123/90.11

(58) Field of Classification Search ..... 137/554; 123/90.11; 324/207.15, 207.19, 207.2, 207.21, 324/207.22, 207.24
See application file for complete search history.

(56) References Cited

U.S. PATENT DOCUMENTS

| | | | | |
|---|---|---|---|---|
| 3,777,255 | A * | 12/1973 | Young et al. | 324/207.17 |
| 4,314,202 | A * | 2/1982 | Okubo | 324/207.15 |
| 4,710,709 | A * | 12/1987 | Anderson et al. | 324/207.17 |
| 4,717,874 | A | 1/1988 | Ichikawa et al. | |
| 4,723,503 | A * | 2/1988 | Yuda | 324/207.24 |

(Continued)

FOREIGN PATENT DOCUMENTS

DE 37 03 867 A1 8/1988

(Continued)

OTHER PUBLICATIONS

"MuMetal". The MuShield Company [online]. Copyright 1998-2006 [retrieved on Jul. 20, 2006]Retrieved from the Internet: <http://www.mumetal.com/about_mumetal.html>.*

*Primary Examiner*—John Rivell
(74) *Attorney, Agent, or Firm*—Tarolli, Sundheim, Covell & Tummino LLP

(57) ABSTRACT

An actuator for actuating a non-camshaft driven lift valve (12) of an internal combustion engine (10) includes a reciprocating tappet (20) that is coupled to the lift valve (12), a target ring (26) being attached to the outer circumference of the tappet, the target ring (26) having at least one slit and being made as a separate prefabricated part and consisting of an Fe-based material or of a ferritic material.

27 Claims, 5 Drawing Sheets

U.S. PATENT DOCUMENTS

| | | | | |
|---|---|---|---|---|
| 4,955,334 | A | 9/1990 | Kawamura | |
| 4,984,541 | A * | 1/1991 | Kawamura | 123/90.11 |
| 5,488,566 | A * | 1/1996 | Woolsey | 324/207.15 |
| 5,518,028 | A * | 5/1996 | Walker | 137/554 |
| 6,526,928 | B2 * | 3/2003 | Bauer et al. | 123/90.11 |
| 6,550,494 | B2 * | 4/2003 | Yoneda et al. | 137/554 |

FOREIGN PATENT DOCUMENTS

| | | | |
|---|---|---|---|
| DE | 689 08 142 | T2 | 11/1993 |
| DE | 199 18 993 | A1 | 9/2000 |
| DE | 100 23 654 | A1 | 11/2001 |
| DE | 100 24 997 | A1 | 11/2001 |
| EP | 0 915 319 | A1 | 5/1999 |
| FR | 2 792 765 | A1 | 4/1999 |
| WO | WO 00/70196 | * | 11/2000 |
| WO | WO-03/023196 | A1 | 3/2003 |

* cited by examiner

ACTUATOR FOR ACTUATING A LIFT VALVE

BACKGROUND OF THE INVENTION

The invention relates to an actuator for actuating a non-camshaft driven lift valve of an internal combustion engine, including a reciprocating tappet that is coupled to the lift valve.

PRIOR ART

The non-camshaft valve trains are frequently electromagnetic actuators. In order to be able to precisely position the tappet, its position must be determined as accurately as possible. For this purpose, so-called targets are provided on tappets whose positions can be determined by appropriately designed sensors. So far, mainly so-called copper targets have been used. In this context, a groove in the tappet is filled up with copper. Subsequently, the tappet is normally worked on the outside so that the area filled with copper makes a smooth transition to the adjacent outer surface of the tappet.

The invention provides an actuator that permits the use of more sensitive sensors so that an improved signal quality is achieved. This improvement is possible without a significant increase in the manufacturing work required.

SUMMARY OF THE INVENTION

This is achieved in an actuator of the type mentioned above in that a target ring which has at least one slit and is made as a separate prefabricated part and which consists of an Fe-based material or of a ferritic material, is attached to the outer circumference of the tappet. Thanks to a target ring that is made of an Fe-based material or of a ferritic material, it is possible to use a sensor that works with lower frequencies than is the case with a target made of copper. The signal quality can be additionally improved in that the target ring consists of a separate prefabricated part. This means that, during and after the attachment of the target ring to the tappet, it is no longer so thermally stressed as would be the case, for example, if it were applied by means of melting, in which event a conversion process would occur in the material of the target ring that would change its magnetic properties. Since the target ring has at least one slit, it is possible to place it onto the tappet from the outside without a need for an extra attachment part. In addition to the improved signal quality, considerably easier manufacture and far better position detection are achieved.

Preferably, the actuator has provided therein an induction sensor that operates at low frequency and that detects the position of the target ring and thus of the tappet. When an induction sensor is used, the advantages of the invention will become particularly apparent. The sensors used so far that operate based on eddy current have an excitation frequency of between 100 kHz and 2 MHz. When the structural shape and the dimensions are maintained but use is now made of low frequencies (10-50 kHz), the eddy current principle will no longer work sufficiently effectively. Specifically, the signal-to-noise ratio greatly deteriorates. If a soft magnetic target made of an NiFe-alloy were to be employed that has a high permeability, noise fields such as the earth's magnetic field would cause changes in permeability that would necessitate expensive shielding. The combination of an induction sensor with a soft magnetic target, in particular made of an Fe-alloy containing approx. 3% silicon, allows the use of high application temperatures, offers advantages in terms of manufacturing engineering, and provides a sensor system having an extremely temperature-stable characteristic. In addition, owing to the lower permeabilities and higher coercive field intensities, such inductive sensor systems of actuators are less sensitive to electromagnetic noise fields as are regularly occurring in the surroundings of internal combustion engines.

If the target ring is a ring having one slit, it can preferably be widened elastically to such an extent that it can be slipped onto the tappet from the outside. In this connection, the tappet can, for example, have a circumferential groove to receive the target ring. The target ring is then widened axially or radially from the outside and slipped onto the tappet to then lock in the circumferential groove. The target ring is configured in such a way that the gap is hardly evident after the ring has locked in the groove.

Another way to design the target ring is to make it of two or more adjacent ring segments, preferably circular ring segments, which likewise form separate, prefabricated parts. This embodiment offers the advantage that the target ring does not have to be elastically deformed when it is attached, but rather that the segments are simply laid into the circumferential groove from radially outside of the seat on the tappet.

The target ring should be attached to the tappet without play and without gaps. The target ring can be attached, for example, by plastic deformation of the tappet on an area adjacent to the target ring and/or by plastic deformation of the target ring, so that the target ring is non-detachably secured to the tappet (i.e. it can only be detached by destroying it).

This plastic reshaping is, for example, stamping, kneading, rolling or compression. The target ring is clamped by this reshaping, but preferably a form-fitting connection can also be made.

As an alternative, the target ring could also be attached to the tappet by means of soldering, welding or adhesion.

In order to achieve the most optimal possible positioning and placement of the target ring on the tappet, one embodiment provides that the target ring, seen in a longitudinal section, has an inner side that has at least one projection protruding radially inwards and/or at least one indentation. This projection or indentation can bring about a form-fitting connection in the circumferential direction and/or a form-fitting connection in the axial direction. Here, in order to receive the target ring, the tappet should have a circumferential groove that is adapted to the geometry of the target ring.

Another possibility to achieve a form-fitting connection is to provide the target ring—seen in a longitudinal section—with a trapezoidal cross sectional shape. In this case, the longer base side of the trapezoid should form the inner side.

Preferably, the actuator is an electromagnetic actuator with one or two coils. The tappet forms the armature shaft. It actuates the valve shaft and is coupled to the valve shaft or optionally it is even connected in one piece.

Preferably, the target ring consists of an Fe-alloy having a silicon content of between 1 and 5%; especially preferred is a silicon content amounting to 3%. Alloys of this kind are, on the one hand, good to process and, on the other, permit higher working temperatures than e.g. NiFe-alloys. Since their Curie temperatures are at approx. 750° C., permanent working temperatures of up to 200° C. are possible. The use of target rings made of such an alloy allows to implement sensor systems having extremely temperature-stable characteristics with only slight deviations at high temperatures.

Owing to the low permeabilities and the high coercive field intensities, sensor systems including such target rings are also less sensitive to electromagnetic noise fields of the type occurring in the surroundings of internal combustion engines than sensor systems having targets made of an NiFe-alloy or of copper. The target ring made of an Fe-alloy having a silicon content of between 1 and 5%, more particularly approx. 3%, and an actuator equipped with such a target ring, are very advantageous, irrespective of claim 1, and present per se essential innovations as compared to the prior art, so that even a non-slit target ring and an actuator including a non-slit target ring made of this alloy would have the advantages just mentioned.

In a preferred embodiment the sensor includes an outer sleeve made of a ferromagnetic or ferritic material such as e.g. an NiFe-alloy having a nickel content of between 72 and 83%. The sleeve serves, on the one hand, for magnetic reflux conduction and, on the other, as a shield from external noise fields.

In summary, the invention provides an actuator having a more sensitive sensor/target system, by means of which the signal quality and the precision of the position determination can be markedly improved. Moreover, the production of the target is cost-effective and its attachment to the tappet is simple and reliable. The fluctuations in the material properties of the target can also be reduced since the target is not thermally applied into a groove and thus its material properties do not change, but rather, in that a prefabricated target is fixed to the tappet without being exposed to extreme temperature stresses.

Further features and advantages of the invention will be apparent from the following description and from the following drawings, to which reference is made.

DETAILED DESCRIPTION OF PREFERRED EMBODIMENTS

Figure 1:
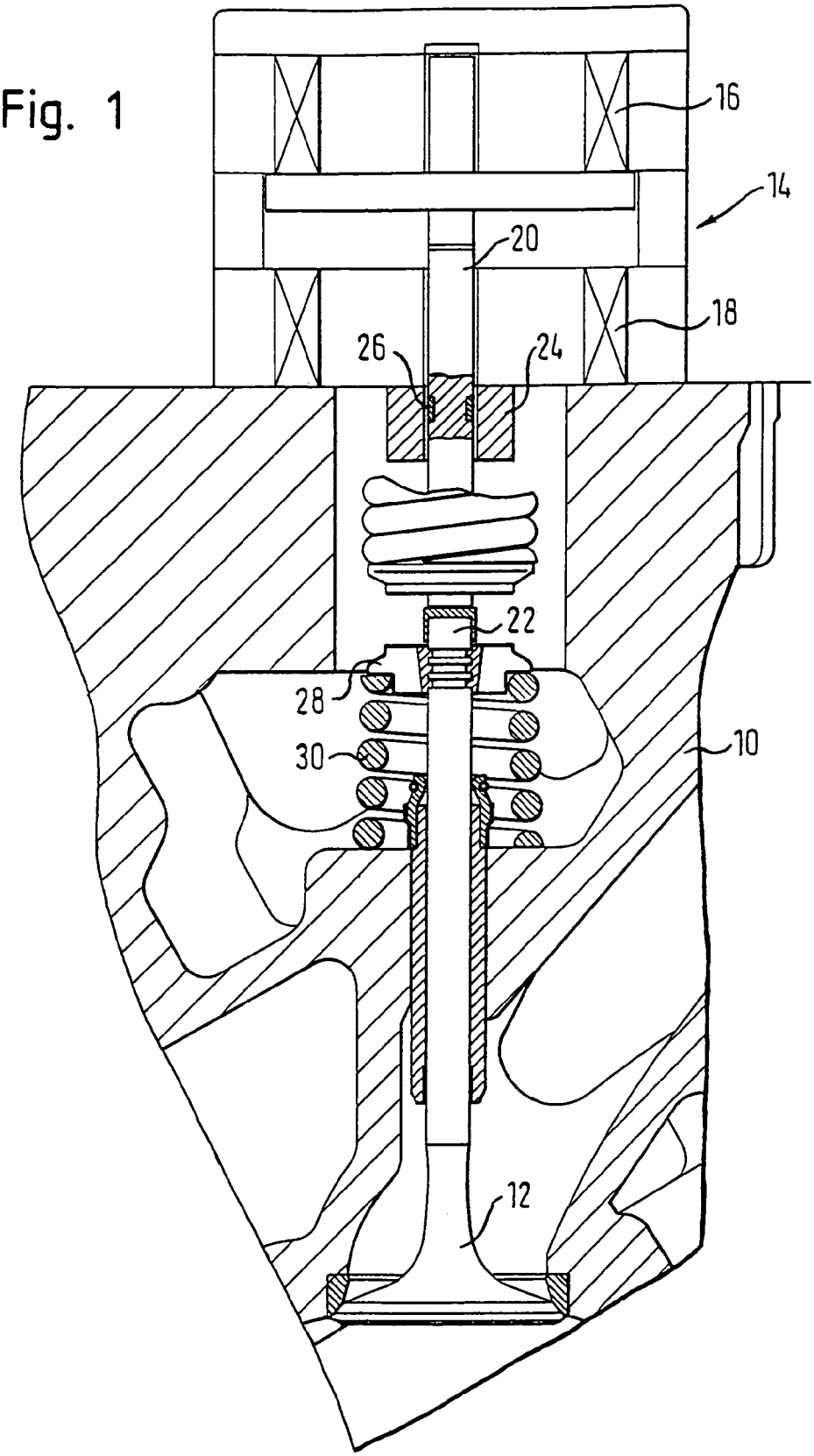
FIG. 1 shows a longitudinal sectional view through a non-camshaft electromagnetic actuator installed in an internal combustion engine for actuating the lift valve of the internal combustion engine.

FIG. 1 shows an internal combustion engine 10 in the area of the cylinder head; in this engine, the lift valve 12 is actuated by a non-camshaft valve train in the form of an electromagnetic actuator 14. The actuator 14 comprises two electromagnets 16, 18 through which an armature, or to put it in more general terms, a tappet 20, extends whose lower end is connected to the valve shaft 22 so that the axial reciprocation of the tappet 20 immediately brings about a corresponding movement of the lift valve 12. The axial movement of the tappet 20 should take place in a path-controlled manner, which is why the position of the tappet has to be determined as precisely and quickly as possible. A sensor 24 which surrounds the tappet and which works inductively and at low frequencies, is provided for determining the position of the tappet 20. Radially inwards from the sensor 24, a target ring 26 is attached without play and without gaps in a circumferential groove in the tappet 20. The sensor 24 determines the position of the target ring 26 and thus of the tappet 20 and of the lift valve 22.

The target ring 26 is made of an Fe-based material or of a ferritic material. In accordance with a preferred embodiment, the target ring 26 according to all of the embodiments shown is a thin-walled, soft magnetic ring made of an iron alloy having a silicon content of approx. 3%. In the embodiment shown in FIG. 1, like in all of the other embodiments as well, the target ring is a separate prefabricated part that is attached to the tappet. The tappet 20 is preferably a non-magnetic steel rod.

FIG. 1 also shows that the lift valve 12 is pressed into the closed position shown by means of a compression spring 30 that engages a spring plate 28 that is attached to the valve shaft 22.

There are all kinds of ways to configure the target ring 26. In the embodiment according to FIG. 2*a*, the target ring 26 is a ring with one slit and has such an elasticity that it can be slipped axially or radially onto the outer circumference of the tappet 20 and locks in the circumferential groove.

Figure 2A:
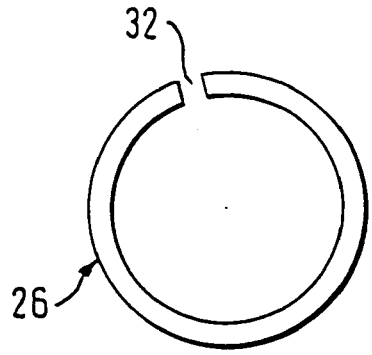
FIGS. 2*a* to 2*c* show various embodiments of the target ring that can be used in the actuator according to the invention.

In the embodiment according to FIG. 2*a*, the dimensions and the geometry of the target ring 26 should be coordinated with the circumferential groove on the tappet 20 and thus with the outer circumference in such a way that the slit 32 is only slightly or not at all evident after the attachment to the tappet. In any case, the target ring 26 is attached to the tappet without play, which also applies to the other embodiments. Additionally, it could also be provided that the target ring is glued to the base of the circumferential groove on the inner side.

Figure 2B:
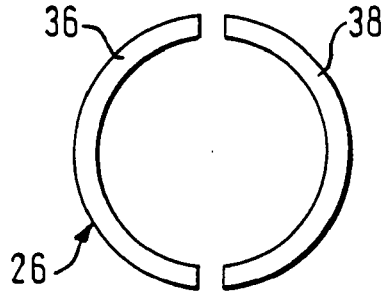

In the embodiment according to FIG. 2*b*, the target ring 26 consists of two ring segments 34, 36, which are simply placed from radially outside onto the tappet, or to put it in more precise terms, inserted into the circumferential groove that forms sections of the outer circumference. The segments, that is to say, cylinder half-shells 36 and 38, can also be attached to each other or in the circumferential groove by means of welding, soldering or adhesion, or by the deformation processes that will be described below. With this embodiment as well, it is important for the dimensions of the segments 36, 38 to be precisely coordinated with the circumferential groove so that, if at all possible, there is no gap or joint radially and circumferentially between the segments 36, 38. On the contrary, the segments 36, 38 should lie against the shaft without play.

Figure 2C:
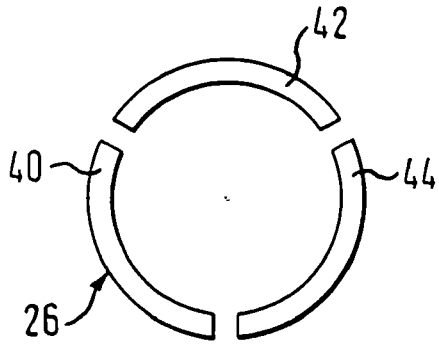

The same applies to the embodiment according to FIG. 2*c*, in which three segments 40 to 44 are provided.

Figure 3A:
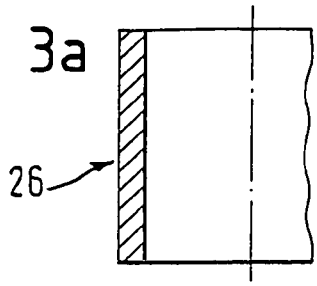
FIGS. 3*a* to 3*e* show longitudinal sections through target rings that can be used in the invention, according to three different embodiments.

As shown in FIG. 3*a*, the target ring 26 can be circular cylindrical.

Figure 3B:
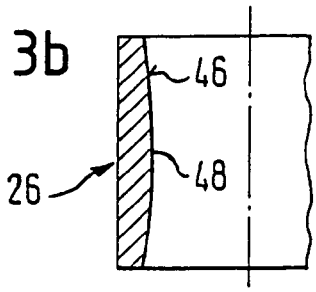
Figure 3C:
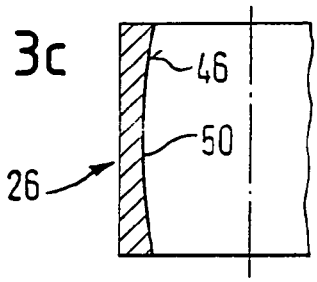
Figure 3D:
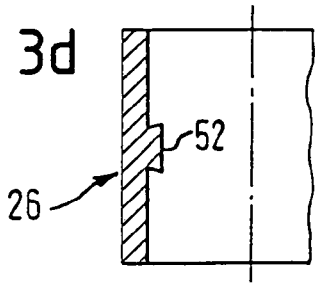
Figure 3E:
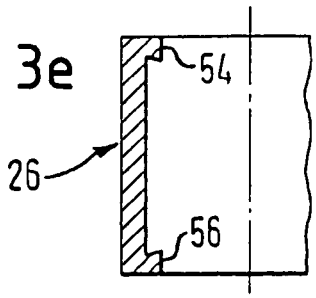

In the embodiment according to FIG. 3*b*, a convex, circumferential projection extends radially inwards on the inner side 46, whereas in the embodiment according to FIG. 3*c*, a circumferential indentation is provided on the inner side 46; in other words, the inner side 46 is concave in shape. According to FIG. 3*d*, a projection 52 with a rectangular cross section extends radially inwards and according to FIG. 3*e*, two such projections 54, 56 extend radially inwards. This design is intended to achieve a better connection with the tappet, whose groove should have a shape that is complementary to the geometry of the inner side 46.

Figure 4A:
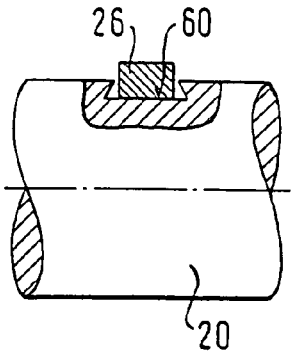
FIGS. 4*a* to 4*c* show consecutive process steps of the attachment of a target onto the tappet in the actuator according to the invention.
Figure 4B:
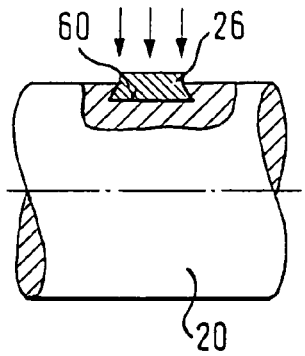
Figure 4C:
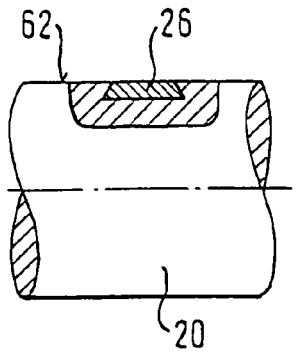

FIGS. 4*a* to 4*c* show that the circumferential groove 60 in the original state has a trapezoidal shape, similar to a dovetail configuration. A target ring 26 with a rectangular cross section, which can have one or more slits, is placed into the circumferential groove 60. Subsequently, the outside surface of the target ring 26 is plastically deformed, for example, by rolling or compression and the target ring is pressed into the circumferential groove such that it completely fills the latter. In order to ensure that the circumferential groove 60 is indeed completely filled as a result of this deformation and that the target ring 26 is accommodated therein in a form-fitting manner, the volume of the target ring 26 is configured somewhat larger than the volume of the circumferential groove 60 so that, as shown in FIG. 4*b*, in the completely pressed-in state, a bit of the material of the target ring 26 still projects radially. The tappet 20, together with the target ring, is subsequently finished by grinding on the outside until a cylindrical outer surface is obtained and there is no longer a joint between the target ring 26 and the outer circumference 62 of the tappet.

Figure 5A:
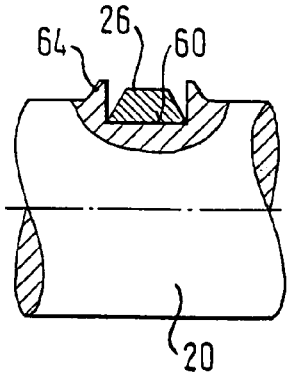
FIGS. 5*a* to 5*c* show consecutive process steps of another attachment of a target on the tappet in the actuator according to the invention.
Figure 5B:
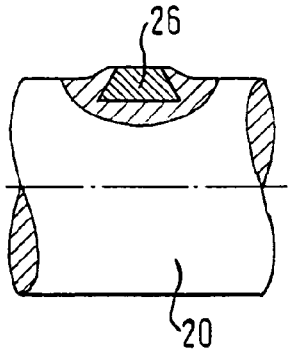
Figure 5C:
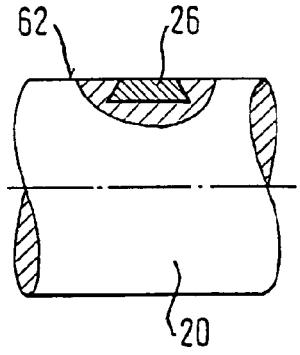

In the embodiment shown in FIG. 5*a*, the tappet has a rectangular circumferential groove 60 with annular rings 64 that project radially to the side of the groove on both axial sides and that are either made during the prefabrication, e.g. turning the tappet 20 on a lathe, or else by means of subsequent reshaping. In this embodiment, the cross section of the target ring 26 has a trapezoidal shape, the longer base side of the trapezoid forming the inner side of the target ring. After the target ring or the segments that form the target ring have been put into place, the material of the tappet adjacent to the circumferential groove 60 is plastically deformed, for example by kneading, rolling, compression or other plastic deformation processes. The annular rings 64 thus shift axially to the target ring 26 and, in the deformed state, the target ring 26 is accommodated gap-free in the annular groove 60 (FIG. 5*b*). Subsequently, the outside 62 of the tappet 20, together with the target ring, is finished by grinding as explained for FIG. 4*c* (see also FIG. 5*c*).

Figure 6A:
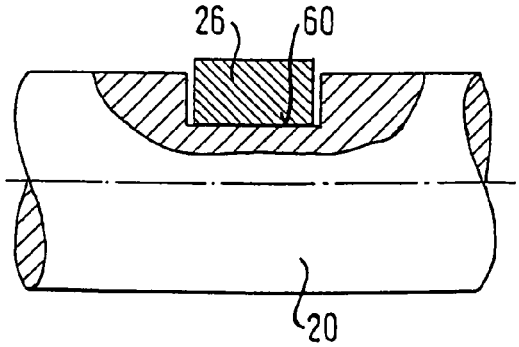
FIGS. 6*a* and 6*b* show consecutive process steps of yet another attachment of a target on a tappet in the actuator according to the invention.
Figure 6B:
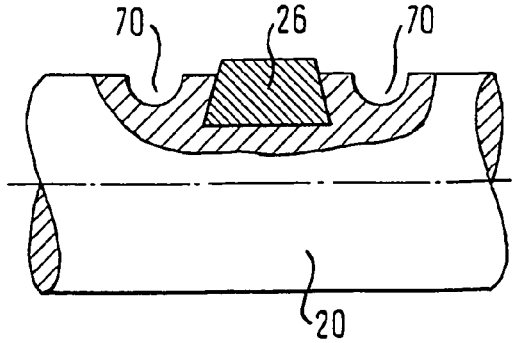

In the embodiment according to FIG. 6*a*, the target ring 26 and the circumferential groove 60 have rectangular cross sections, with a slight axial play between the target ring 26 and the side walls of the circumferential groove 60 being present in the inserted state, which is shown in FIG. 6*a*. Subsequently, in areas of the tappet immediately adjacent to the target ring 26, the tappet is shaped, for example, by rolling, in such a way that grooves 70 are formed and the material of the tappet 20 is pressed towards the target ring 26 in order to clamp it and, at the same time, to lock it in a form-fitting manner in the circumferential groove 60. In this embodiment, however, it is not only the tappet 20 that is deformed but also the target ring 26.

Figure 7:
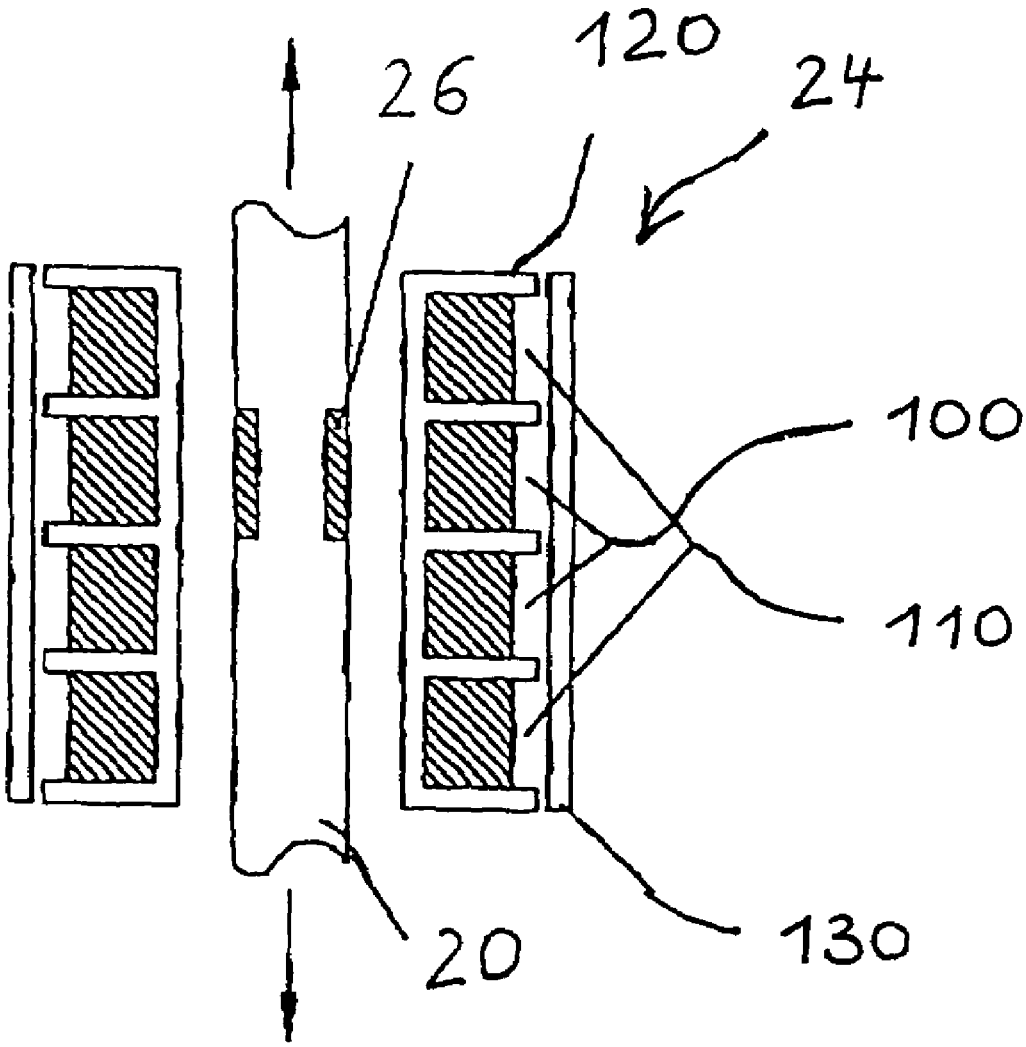
FIG. 7 shows a longitudinal sectional view of a sensor for detecting the position of the target in an actuator according to the invention.

FIG. 7 shows an exemplary embodiment of a sensor 24 that may be used with any of the embodiments, for detecting the position of the target ring 26. The sensor 24 includes a pair of first series-connected inner coils 100 that are disposed side by side and are flanked by a pair of second outer coils 110. The two outer coils 110 are connected in series with the inner coils 100 and serve to compensate fringe effects of the sensor coils. The center tap of the two first coils 100 serves as a signal tap, so that an inductive half bridge is provided.

The coils 100, 110 are arranged on a coil former 120 that consists of a non-conductive material, preferably of plastic material or ceramics, for example of a glass fiber reinforced and/or carbon fiber reinforced plastic material. A coil former 120 of this type is adapted to withstand even high application temperatures and may in addition be produced at low cost on a large scale by injection molding.

A sleeve 130 extends around the coils 100, 110, the sleeve 130 being made of a ferromagnetic or ferritic material, preferably of an NiFe-alloy having a nickel content of between 72 and 83%. The sleeve serves for magnetic reflux conduction in that it bundles the magnetic fields exiting the coil system 100, 110, 120, so that the inevitable leakage flux is minimized. In addition, it acts as a shield against noise fields.

The tappet 20 carrying the target ring 26 extends through the coils 100, 110. Here, the target ring 26 is a thin-walled, soft magnetic ring made of an iron alloy having a silicon content of approx. 3%. The target ring 26 is connected to the tappet 20 in accordance with any of the methods described above.

The integral joining of the target ring 26 to the tappet 20 is followed in this example by a final annealing for selectively setting the magnetic properties of the target ring 26. Except for this final annealing, no further thermal treatment is required. Any further, possibly required final treatments (e.g. grinding) will only insignificantly change the magnetic properties of the target ring as set by the final annealing.

The invention claimed is:

1. An actuator for actuating a non-camshaft driven lift valve (12) of an internal combustion engine (10), with a reciprocating tappet (20) that is coupled to the lift valve (12), characterized in that a target ring (26) which has preferably at least one slit and is made as a separate prefabricated part and which consists of an Fe-based material or of a ferritic material, is attached to the outer circumference of the tappet.

2. The actuator according to claim 1, characterized in that near the target ring (26) a sensor (24) is provided that operates at low frequency and according to the induction principle and that can detect the position, the speed and/or the acceleration of the target ring (26) and thus of the tappet (20).

3. The actuator according to claim 2, characterized in that the sensor (24) includes an outer sleeve (130) made of a ferromagnetic or ferritic material for magnetic reflux conduction and for reducing leakage flux.

4. The actuator according to claim 3, characterized in that the sleeve (130) consists of an NiFe-alloy having a nickel content of between 72 and 83%.

5. The actuator according to claim 2, characterized in that the sensor (24) includes a pair of outer coils (110) and a pair of adjacent inner coils (100) that are accommodated between the outer coils and connected in series.

6. The actuator according to claim 5, characterized in that a center tap of the two inner coils (100) constitutes a signal tap.

7. The actuator according to claim 5, characterized in that the coils (100, 110) are arranged on a nonconducting coil former (120).

8. The actuator according to claim 1, characterized in that the target ring (26) is a ring with one slit that can be widened elastically to such an extent that it can be slipped onto the tappet (20) from the outside.

9. The actuator according to claim 1, characterized in that the target ring (26) is made up of two or more ring segments that are circumferentially adjacent to each other and that form separate, prefabricated parts.

10. The actuator according to claim 1, characterized in that the target ring (26) is non-detachably secured to the tappet on an area that is adjacent to the target ring (26) by means of plastic deformation of the target ring (26) itself and/or of the tappet.

11. The actuator according to claim 10, characterized in that the target ring (26) is attached to the tappet (20) in a form-fitting manner by the deformation action.

12. The actuator according to claim 10, characterized in that the target ring is secured to the tappet (20) in an area adjacent to the target ring (26) by means of stamping, kneading, or rolling or compression of the tappet (20).

13. The actuator according to claim 1, characterized in that the target ring (26) is attached to the tappet (20) by means of soldering, welding or adhesion.

14. The actuator according to claim 1, characterized in that the target ring (26) is accommodated in a circumferential groove (60) in the tappet (20).

15. The actuator according to claim 14, characterized in that the circumferential groove (60) is shaped so as to be complementary to the target ring (26).

16. The actuator according to claim 1, characterized in that the target ring (26), seen in a longitudinal section, has an inner side (46) that has at least one projection (48; 54, 56) protruding radially inwards and/or at least one indentation (50).

17. The actuator according to claim 16, characterized in that the target ring (26) has several projections (54, 56) that protrude radially inwards and the tappet (20) has complementarily shaped indentations to receive the projections (54, 56).

18. The actuator according to claim 16, characterized in that the projection (48) is convex in shape and the indentation (50) is concave in shape.

19. The actuator according to claim 1, characterized in that the target ring (26), seen in a longitudinal section, has a trapezoidal cross section, the longer base side forming the inner side of the target ring (26).

20. The actuator according to claim 1, characterized in that the actuator is an electromagnetic actuator and the tappet forms the armature shaft, the armature shaft being coupled to the valve shaft (22).

21. The actuator according to claim 1, characterized in that the target ring (26) consists of an Fe-alloy having a silicon content of between 1 and 5%.

22. The actuator according to claim 21, characterized in that the target ring (26) consists of an Fe-alloy having a silicon content of approx. 3%.

23. An actuator for actuating a non-camshaft driven lift valve (12) of an internal combustion engine (10), with a reciprocating tappet (20) that is coupled to the lift valve (12), characterized in that a metal target ring (26) which has preferably at least one slit and is made as a separate prefabricated part and which consist of an Fe-based material or of a ferritic material, is attached to the outer circumference of the tappet, the target ring, seen in a longitudinal section, having a radial inner axial length and a radial outer axial length, the radial inner axial length being greater than the radial outer axial length and the target ring (26) being non-detachably secured to the tappet on an area that is adjacent to the target ring (26) by means of plastic deformation of the target ring (26) itself and/or of the tappet.

24. An actuator for actuating a non-camshaft driven lift valve (12) of an internal combustion engine (10), with a reciprocating tappet (20) that is coupled to the lift valve (12), characterized in that a target ring (26) which has preferably at least one slit and is made as a separate prefabricated part and which consists of an Fe-based material or of a ferritic material, is attached to the outer circumference of the tappet, near the target ring (26) a sensor (24) is provided that operates at low frequency and according to the induction principle and that can detect the position, the speed and/or the acceleration of the tappet ring (26) and thus of the tappet (20), the sensor (24) includes a pair of outer coils (110) and a pair of adjacent inner coils (100) that are accommodated between the outer coils and connected in series.

25. An actuator for actuating a non-camshaft driven lift valve of an internal combustion engine, said actuator comprising a tappet formed of a nonmagnetic material and having a first end portion connected to an end portion of the lift valve, an armature formed of a ferromagnetic material and engagable with a second end portion of said tappet, an electromagnet which is energizable to magnetically attract said armature and effect movement of said tappet and said lift valve, a target ring connected to said tappet at a location between said first and second end portions of said tappet, said target ring being formed as a separate prefabricated cart formed of an Fe-based material or of a ferritic material and is attached to said tappet at a location spaced from said lift valve, further including a sensor which extends around said tappet and includes a plurality of coils disposed on a coil former formed of a nonmagnetic material said sensor including a sleeve which is formed of a ferromagnetic or ferritic material and extends around said coil former and said plurality of coils.

26. An actuator as set forth in claim 25 wherein said coil former includes a side wall which is formed of a nonmagnetic material and is disposed between said plurality of coils and said target ring.

27. An actuator as set forth in claim 26 wherein said coil former includes a plurality of walls which extend radially outward from said side wall of said coil former, each of said coils of said plurality of coils being disposed between a pair of walls of said plurality of walls which extend radially outward from said side wall of said coil former.

* * * * *